US008342342B1

(12) United States Patent
Vandelaar

(10) Patent No.: US 8,342,342 B1
(45) Date of Patent: Jan. 1, 2013

(54) ADJUSTABLE, COLLAPSIBLE CLOTHES RACK

(76) Inventor: Brandon D. Vandelaar, Lakewood, CO (US)

( * ) Notice: Subject to any disclaimer, the term of this patent is extended or adjusted under 35 U.S.C. 154(b) by 259 days.

(21) Appl. No.: 12/827,008

(22) Filed: Jun. 30, 2010

(51) Int. Cl.
*A47B 43/00* (2006.01)
*A47B 47/00* (2006.01)
*A47F 5/00* (2006.01)

(52) U.S. Cl. ..... 211/85.24; 211/198; 211/200

(58) Field of Classification Search ..... 211/85.24, 211/197, 200, 198, 204, 175, 195, 206, 189; 248/166
See application file for complete search history.

(56) References Cited

U.S. PATENT DOCUMENTS

| | | | | | |
|---|---|---|---|---|---|
| 25,039 | A * | 8/1859 | Parkhurst | 211/198 |
| 160,980 | A * | 3/1875 | Whipple | 211/198 |
| 181,351 | A * | 8/1876 | Lee | 211/198 |
| 338,011 | A * | 3/1886 | Adams, Jr. | 211/198 |
| 426,697 | A * | 4/1890 | Webb | 211/150 |
| 543,020 | A * | 7/1895 | Holmes | 211/198 |
| 753,993 | A * | 3/1904 | Mauran | 211/198 |
| 1,545,072 | A * | 7/1925 | Stearns | 211/198 |
| 1,599,083 | A * | 9/1926 | Gagne | 211/198 |
| 1,605,506 | A * | 11/1926 | Brunhoff | 211/85 |
| 1,628,936 | A * | 5/1927 | Turner | 211/119.011 |
| 2,481,577 | A * | 9/1949 | De Puy et al. | 248/157 |
| 2,647,643 | A | 8/1953 | Cruikshank | |
| 2,744,712 | A * | 5/1956 | Brandt | 248/451 |
| 3,087,624 | A * | 4/1963 | Hucker | 211/87.01 |
| 3,249,232 | A * | 5/1966 | Pokorski | 211/198 |
| 3,298,537 | A * | 1/1967 | Di Marco | 211/200 |
| 3,767,149 | A * | 10/1973 | Hill | 248/49 |
| 4,094,414 | A | 6/1978 | Thiot et al. | |
| 4,290,532 | A * | 9/1981 | Reynolds | 211/200 |
| 4,632,255 | A | 12/1986 | Kennedy | |
| 4,763,865 | A * | 8/1988 | Danner | 248/164 |
| 5,019,126 | A | 5/1991 | Post | |
| 5,199,930 | A * | 4/1993 | Weber | 482/17 |
| 5,287,971 | A * | 2/1994 | Dorman | 211/12 |
| 5,507,399 | A * | 4/1996 | Hermanson | 211/181.1 |
| D414,625 | S | 10/1999 | Stelmarski | |
| 5,967,342 | A * | 10/1999 | Steffine | 211/85.24 |
| 6,179,256 | B1 * | 1/2001 | Utterback | 248/166 |
| 6,837,385 | B2 * | 1/2005 | Bennett et al. | 211/118 |
| 2003/0164343 | A1 * | 9/2003 | Kaufmann | 211/13.1 |
| 2009/0184073 | A1 * | 7/2009 | Lu | 211/85.3 |

* cited by examiner

*Primary Examiner* — Jennifer E. Novosad

(57) ABSTRACT

The adjustable, collapsible clothes rack is easily portable due to the telescopic fit of the leg inserts within the legs and the slideable cross bar insert within the cross bar. Additionally, the pivoted fastening of the legs to the cross bar assembly provides for a further compact state. The expandable and retractable features of the apparatus provide for fit to a variety of surfaces. The rubberized leg insert stoppers and the suction cups provide for apparatus position retention on a given surface. Further, the suction cups are pivoted and thereby even allow for the cups to be removably attached to a wall or other surface at and angle to the positioning of the leg inserts.

1 Claim, 3 Drawing Sheets

ADJUSTABLE, COLLAPSIBLE CLOTHES RACK

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Hanging clothes anywhere, especially near an appliance such as a washer or dryer, can be convenient. Hanging clothes for drying not only spares certain fabrics but also saves energy that might other be spent in mechanical drying. Additionally, just having a portable clothes hanger often provides advantages. These advantages are increased if the portable hanger is collapsible or easily capable of disassembly. The present apparatus provides several unique features and advantages over existing portable clothes racks.

FIELD OF THE INVENTION

The adjustable, collapsible clothes rack relates to clothes racks and clothes hangers and more especially to a portable adjustable and collapsible clothes rack apparatus.

SUMMARY OF THE INVENTION

The general purpose of the adjustable, collapsible clothes rack, described subsequently in greater detail, is to provide a adjustable, collapsible clothes rack which has many novel features that result in an improved adjustable, collapsible clothes rack which is not anticipated, rendered obvious, suggested, or even implied by prior art, either alone or in combination thereof.

To attain this, the adjustable, collapsible clothes rack is easily portable due to the telescopic fit of the leg inserts within the legs and the slideable cross bar insert within the cross bar. Additionally, the pivoted fastening of the legs to the cross bar assembly provides for a further compact state. Therefore, the expandable and retractable features of the apparatus provide for fit to a variety of surfaces. The rubberized leg insert stoppers and the suction cups provide for apparatus position retention on a given surface. Further, the suction cups are pivoted and thereby even allow for the cups to be removably attached to a wall or other surface at an angle to the positioning of the leg inserts. The legs, inserts, and cross bar may be made of a variety of materials including but not limited to plastics and metals, with design choices given to tubular stock for weight savings. The adjustment mechanisms for the cross bar with slideable cross bar insert and the legs with leg inserts may be ball detents.

Thus has been broadly outlined the more important features of the improved adjustable, collapsible clothes rack so that the detailed description thereof that follows may be better understood and in order that the present contribution to the art may be better appreciated.

An object of the adjustable, collapsible clothes rack is to provide for hanging clothes and other items.

Another object of the adjustable, collapsible clothes rack is to be capable of disassembly.

A further object of the adjustable, collapsible clothes rack is to collapsible.

An added object of the adjustable, collapsible clothes rack is to provide frictional contact with given surfaces.

And, an object of the adjustable, collapsible clothes rack is to provide a releasable means for adhering to a given surface.

Yet another object of the of the adjustable, collapsible clothes rack is to provide for retainable positioning on differently angled adjacent surfaces.

These together with additional objects, features and advantages of the improved adjustable, collapsible clothes rack will be readily apparent to those of ordinary skill in the art upon reading the following detailed description of presently preferred, but nonetheless illustrative, embodiments of the improved adjustable, collapsible clothes rack when taken in conjunction with the accompanying drawings.

In this respect, before explaining the current embodiments of the improved adjustable, collapsible clothes rack in detail, it is to be understood that the adjustable, collapsible clothes rack is not limited in its application to the details of construction and arrangements of the components set forth in the following description or illustration.

Those skilled in the art will appreciate that the concept of this disclosure may be readily utilized as a basis for the design of other structures, methods, and systems for carrying out the several purposes of the improved adjustable, collapsible clothes rack. It is therefore important that the claims be regarded as including such equivalent constructions insofar as they do not depart from the spirit and scope of the adjustable, collapsible clothes rack. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the adjustable, collapsible clothes rack generally designated by the reference number 10 will be described.

Figure 2:
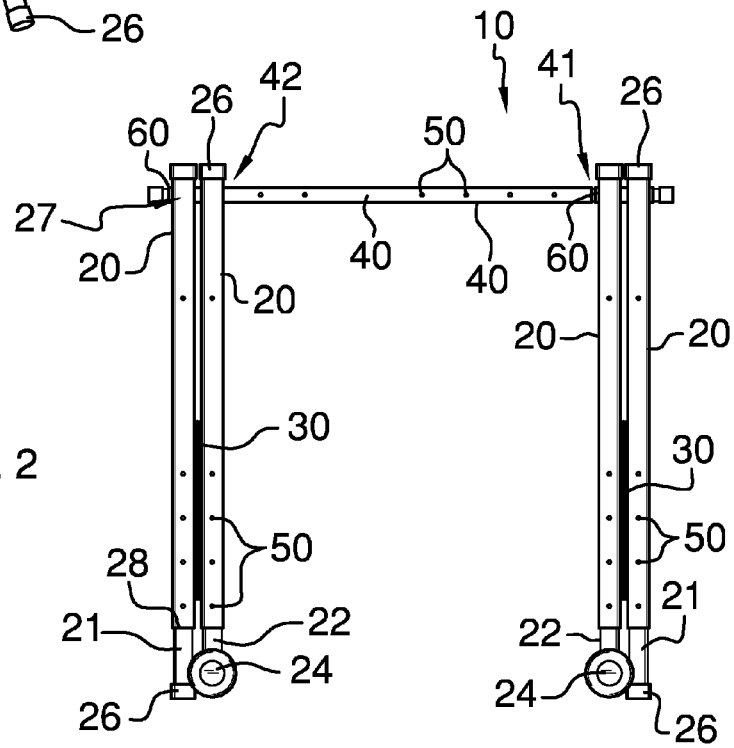
FIG. 2 is a rear elevation view with legs pivoted together.

Referring to FIG. 2, apparatus 10 partially comprises the horizontal cross bar 40 has a first end 41 spaced apart from a second end 42.

Figure 5:
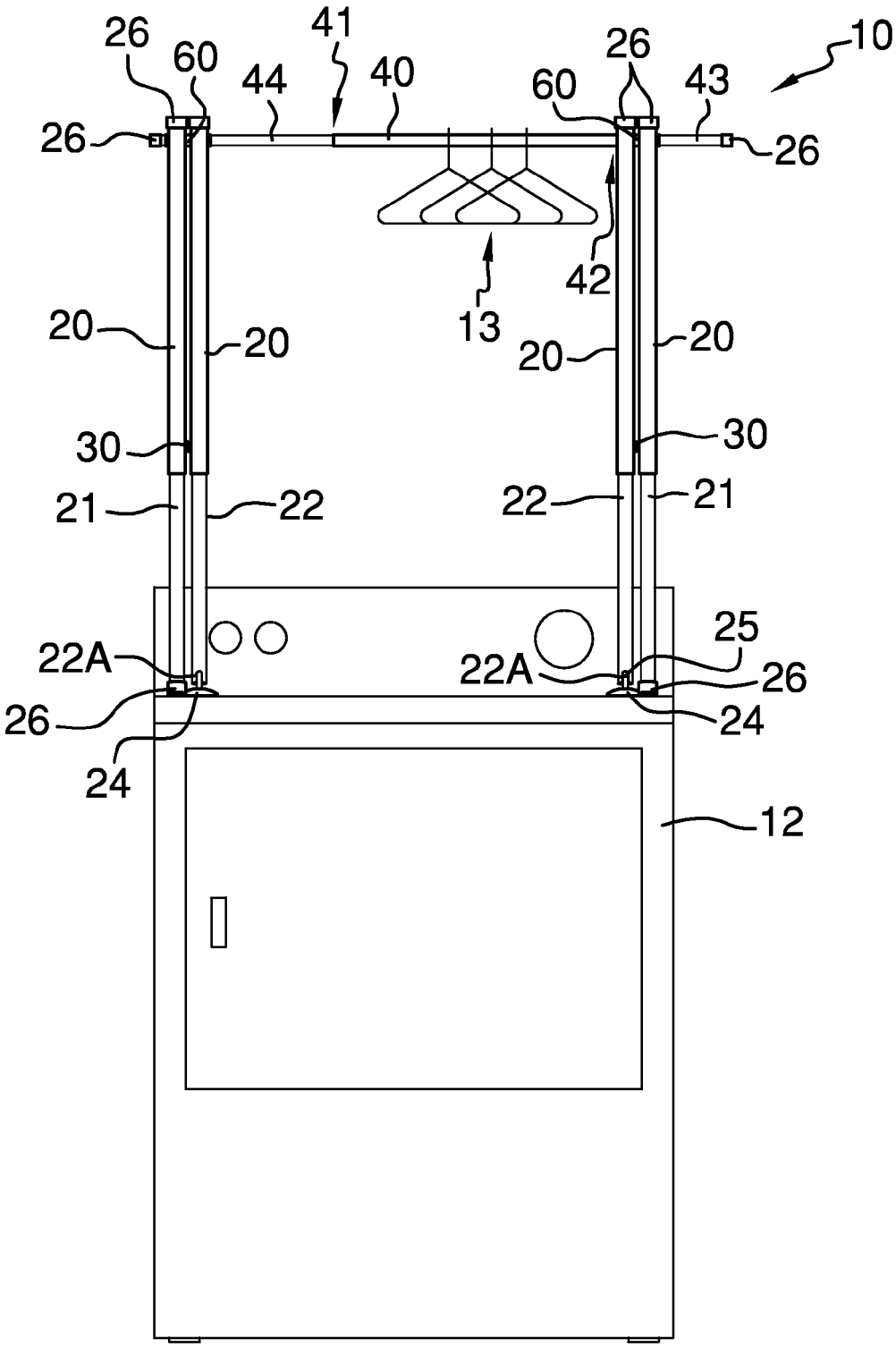
FIG. 5 is a front elevation view of the apparatus installed atop an appliance.

Referring to FIG. 5, the slideable cross bar insert 44 is disposed in the cross bar 40 first end 41.

Referring again to FIG. 2, the adjustment mechanism 50 selectively locates the slideable cross bar insert 44 within the cross bar 40. A sleeve 60 is disposed around the slideable cross bar insert 44. The cross bar insert 43 is disposed in the second end 42 of the cross bar 40. A sleeve 60 is disposed around the cross bar insert 43.

Figure 1:
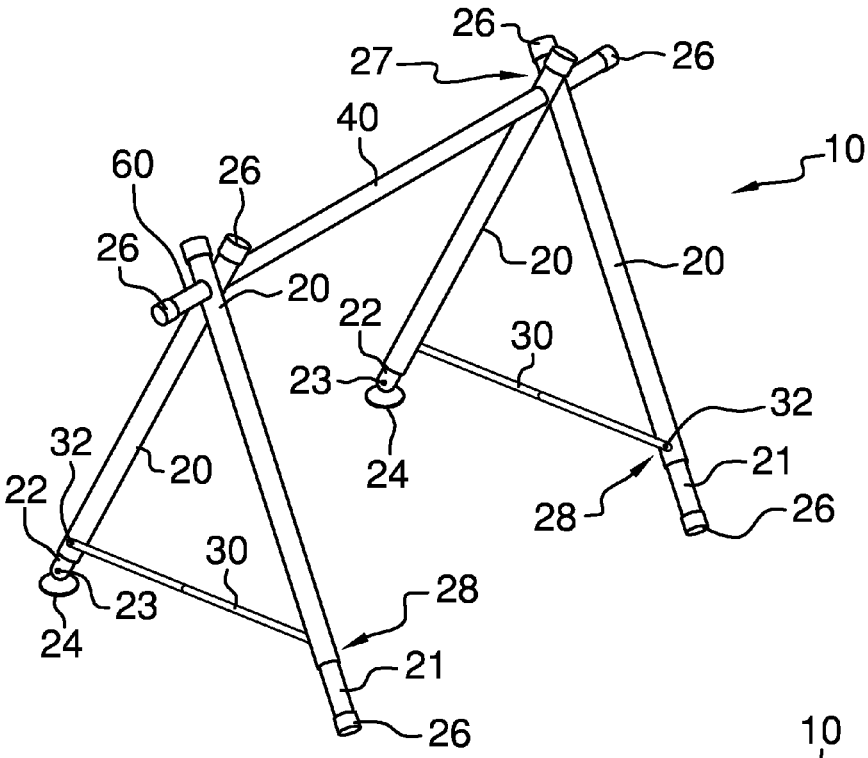
FIG. 1 is a perspective view in a partially expanded state.

Referring to FIG. 1, a rubberized stopper 26 is disposed outwardly within the cross bar insert 43 and slideable cross bar insert 44. A quartet of identical legs 20 is provided. Each leg 20 has a top 27 spaced apart from a bottom 28. Each leg 20 is adjacently paired with one other leg 20 and pivoted on one of each of the sleeves 60. Each leg 20 is thereby extended perpendicularly from the inserts and cross bar 40. A rubberized stopper 26 is disposed upwardly within each leg 20.

Figure 3:
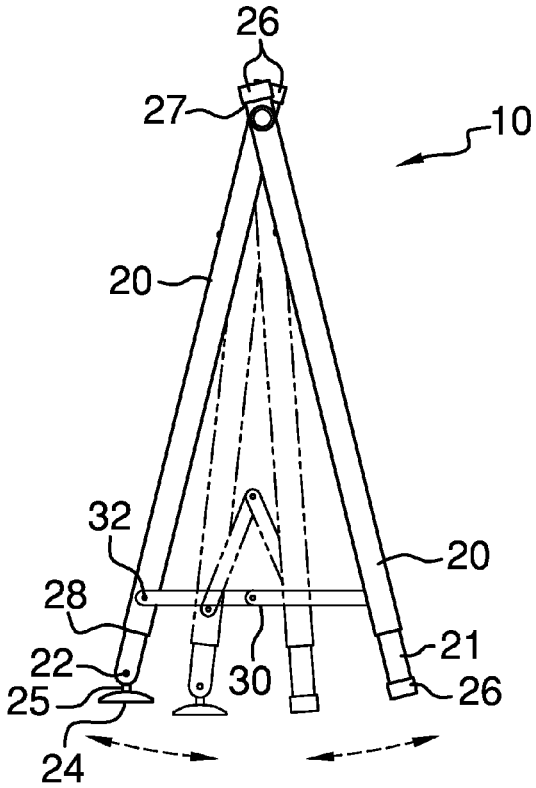
FIG. 3 is an end elevation view illustrating leg pivot and hinge pivot.

Referring to FIG. 3, a hinged cross support 30 is pivotally connected to each paired leg 20 via a support pivot 32. The cross support 30 is disposed proximal to each leg 20 bottom 28.

Figure 4:
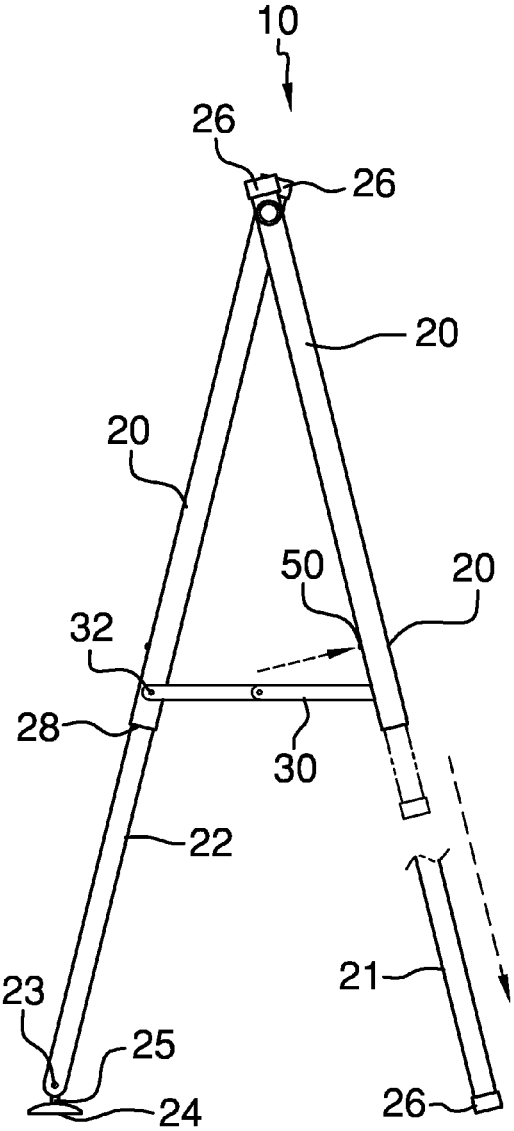
FIG. 4 is an end elevation view illustrating adjustable height via slideable leg inserts.

Referring to FIG. 4, a leg insert 21 is slideably disposed within one of each of the paired legs 20. A rubberized stopper 26 is disposed downwardly within each leg insert 21.

Continuing to refer to FIG. 4 and referring also to FIG. 2, a v-notched leg insert 22 is slideably disposed within one of each of the paired legs 20. The notch 22A is disposed downwardly in each v-notched leg insert 22. A pivot member 23 is disposed upwardly within each notch 22A. A suction cup 24 with stalk 25 is pivotally disposed within each notch 22A via a stalk 25 extended from the suction cup 24 and pivoted about the pivot member 23. The suction cup 24 is pivoted at least 90 degrees. An adjustment mechanism 50 selectively positions each leg insert 21 and each v-notched leg insert 22 within each leg 20.

Referring again to FIG. 5, the leg inserts 21 and v-notched leg inserts 22 are extended substantially from within the legs 20. The slideable cross bar insert 44 is extended substantially from within the cross bar 40. The stoppers 26 of the leg inserts 21 are placed atop the existing appliance 12. The suction cups 24 are stuck to the appliance 12 top. The frictional rubberized stoppers 26 and the suction cups 24 thereby locate the apparatus 10 until moved by a user. The adjustable length cross bar 40 with slideable cross bar insert 44 allow length adjustment so that the apparatus 10 may fit a variety of surfaces. The pivoted legs 20 with adjustably inserted leg inserts 21 and v-notched leg inserts 22 provide height and breadth adjustment that also provides for the apparatus 10 to fit a variety of surfaces. Hangers 13 may be used on the cross bar 40.

With respect to the above description then, it is to be realized that the optimum dimensional relationships for the parts of the adjustable, collapsible clothes rack, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the adjustable, collapsible clothes rack.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the adjustable, collapsible clothes rack may be used.

Therefore, the foregoing is considered as illustrative only of the principles of the adjustable, collapsible clothes rack. Further, since numerous modifications and changes will readily occur to those skilled in the art, it is not desired to limit the adjustable, collapsible clothes rack to the exact construction and operation shown and described, and accordingly, all suitable modifications and equivalents may be resorted to, falling within the scope of the adjustable, collapsible clothes rack.

What is claimed is:

1. An adjustable, collapsible clothes rack comprising, in combination:

a horizontal cross bar having a first end spaced apart from a second end;

a slideable cross bar insert disposed in the cross bar first end;

an adjustment mechanism selectively locating the slideable cross bar insert within the cross bar;

a sleeve disposed around the slideable cross bar insert;

a cross bar insert disposed in the second end of the cross bar;

a sleeve disposed around the cross bar insert;

a rubberized stopper disposed outwardly within each cross bar insert;

a quartet of identical legs, each leg having a top spaced apart from a bottom, each leg adjacently paired with one other leg and pivoted on one of each of the sleeves and thereby extended perpendicularly from the inserts and cross bar;

a hinged cross support pivotally connected to each paired leg via a support pivot, the cross support disposed proximal to each leg bottom;

a rubberized stopper disposed upwardly within each leg;

a leg insert slideably disposed within one of each of the paired legs;

a rubberized stopper disposed downwardly within each leg insert;

a v-notched leg insert slideably disposed within one of each of the paired legs;

an adjustment mechanism selectively positioning each leg insert and each v-notched leg insert within each leg;

a notch disposed downwardly in each v-notched leg insert;

a pivot member disposed upwardly within each notch;

a suction cup with stalk pivotally disposed within each notch via a stalk extended from the suction cup and pivoted about the pivot member, the suction cup pivoted at least 90 degrees.

* * * * *